US005927960A

United States Patent [19]

Felderman

[11] Patent Number: 5,927,960

[45] Date of Patent: Jul. 27, 1999

[54] BURNER

[75] Inventor: Christian Juan Felderman, Aston Sheffield, United Kingdom

[73] Assignee: The BOC Group plc, Windlesham, United Kingdom

[21] Appl. No.: 08/713,563

[22] Filed: Sep. 13, 1996

[30] Foreign Application Priority Data

Sep. 21, 1995 [GB] United Kingdom ..... 9519303

[51] Int. Cl.[6] ..... F23R 3/00

[52] U.S. Cl. ..... 431/158; 431/13; 431/181; 431/352

[58] Field of Search ..... 431/158, 13, 352, 431/181; 266/182, 267, 225

[56] References Cited

U.S. PATENT DOCUMENTS

| | | | |
|---|---|---|---|
| Re. 33,464 | 11/1990 | Gitman | 432/13 |
| 3,385,381 | 5/1968 | Calaman . | |
| 4,622,007 | 11/1986 | Gitman | 432/13 |
| 4,752,330 | 6/1988 | Gitman | 266/226 |
| 4,865,297 | 9/1989 | Gitman | 266/226 |
| 5,062,789 | 11/1991 | Gitman | 431/9 |
| 5,635,130 | 6/1997 | Leczo et al. | 266/47 |
| 5,714,113 | 2/1998 | Gitman et al. | 266/182 |

FOREIGN PATENT DOCUMENTS

| | | |
|---|---|---|
| 1496257 | 12/1977 | United Kingdom . |
| 89/02051A1 | 3/1989 | WIPO . |

*Primary Examiner*—Larry Jones
*Attorney, Agent, or Firm*—David M. Rosenblum; William A. Schoneman; Salvator P. Pace

[57] ABSTRACT

A burner arrangement for ferrous scrap melting and the like includes a fuel outlet and a primary oxidant supply outlet communicating with a mixing chamber. The burner also has a main outlet and secondary oxidant supply outlets. In addition there is a convergent-divergent nozzle communicating with the mixing chamber. Valves control the flow of gaseous fuel to the fuel outlet, and the flow of primary and secondary oxidant to the primary and secondary oxidant supply outlets. In operation, oxidant is supplied to the primary and secondary outlets, hot flame or combustion gases are accelerated through the nozzle with the result that a sonic or supersonic velocity can be created. Such high velocities facilitate the penetration of the combustion gases through a slag layer into molten metal.

4 Claims, 4 Drawing Sheets

BURNER

BACKGROUND OF THE INVENTION

The present invention relates to a burner and relates particularly, but not exclusively, to a burner suitable for use in melting metal.

Established metal melting apparatus includes the well known electric arc furnace with supplementary oxygen injection lances (as shown in FIGS. 1 and 2 of the accompanying drawings). Operation of such a furnace involves the striking of an arc between the electrodes to create a heating current which passes through the metal to be melted and the injection of supplementary oxygen via an oxygen injection lance which may be moved closer to or away from the metal as and when desired. Once struck, the arc acts to heat the metal towards its final tap temperature of about 1620° C. to 1700° C. whilst the oxygen acts to oxidise undesirable elements in the metal and causes them to be extracted from the metal and generate an insulating slag layer which floats on the surface of the molten metal. The insulating slag layer acts to protect the electrodes and furnace wall from splattering molten metal. Supplementary oxy/fuel burners are often provided in the furnace wall for assisting the electric arc heating effect. Unfortunately, whilst such burners are of great benefit during the initial melting phase, they are often unable to penetrate the slag layer adequately during the final and critical heating step and are, therefore, of little use in achieving the final tap temperature. Supplementary gas injection tuyeres are often used to inject oxygen and other gases directly into the mass of molten metal during melting. Such tuyeres, whilst promoting circulation of molten metal and hence assisting in heat redistribution, generally inject comparatively cool gas which only acts to exacerbate the problem of achieving the final tap temperature.

It is an object of the present invention to reduce and possibly eliminate the problems associated with the above-mentioned arrangements.

SUMMARY OF THE INVENTION

Accordingly, the present invention provides a burner comprising:

a body portion, having a main outlet;

at least one primary oxygen supply outlet and at least one secondary oxidant supply outlet, said secondary outlet being positioned for supplying oxidant to a position downstream of said main outlet;

a fuel outlet;

a mixing chamber, within the body portion, communicating with said fuel outlet and said primary oxidant supply outlet, for mixing fuel and any primary oxidant;

accelerating means, downstream of the receiving chamber, for accelerating gas from the mixing chamber; and oxidant flow control means, for controlling the flow of oxidant from said first and second oxidant outlets thereby to cause oxidant to issue at different rates from one or other or both of said oxidant outlets during different modes of operation;

whereby upon causing ignition of a mixture of the fuel and one or both of the primary and secondary oxidants the burner is selectively operable in different modes such that combustion can take place either entirely downstream, or both upstream and downstream of said acceleration means, and such that said burner can produce exhaust gases which exit the burner at subsonic, sonic or supersonic speed.

According to a further aspect of the present invention there is provided a method of heating molten metal in a furnace having a wall and a burner as described above including the steps of operating the burner with a sonic or supersonic velocity of flame gases through the accelerating means, and causing hot gases from the burner to enter the molten metal.

The burner many also be operated subsonically, and in the absence of primary oxidant.

The tip of the burner may be positioned during a heating operation in one or more of the following positions: above but close to the surface of molten metal and any slag layer thereupon, within the slag layer, within the molten metal, and at the interface of the molten metal and the slag. The burner may be operated at a superstoichiometric oxidant/fuel mole ratio when it is desired to supply oxidant to the molten metal, and at a stoichiometric or sub-stoichiometric oxidant/fuel mole ratio when it is not desired to supply oxidant to the molten metal.

The burner may include a discrete ignition means such as a piezo-electric device for igniting the fuel oxidant mixture. Alternatively, the burner may include no such discrete ignition means and may instead be lit by an external means such as a glowing taper. Indeed, if the furnace is already at elevated temperature, this of itself will cause the fuel-oxidant mixture emanating from the burner to ignite.

BRIEF DESCRIPTION OF THE DRAWINGS

The present invention will now be more particularly described by way of example only with reference to the accompanying drawings, in which.

The drawings are not to scale.

DETAILED DESCRIPTION

Figure 1:
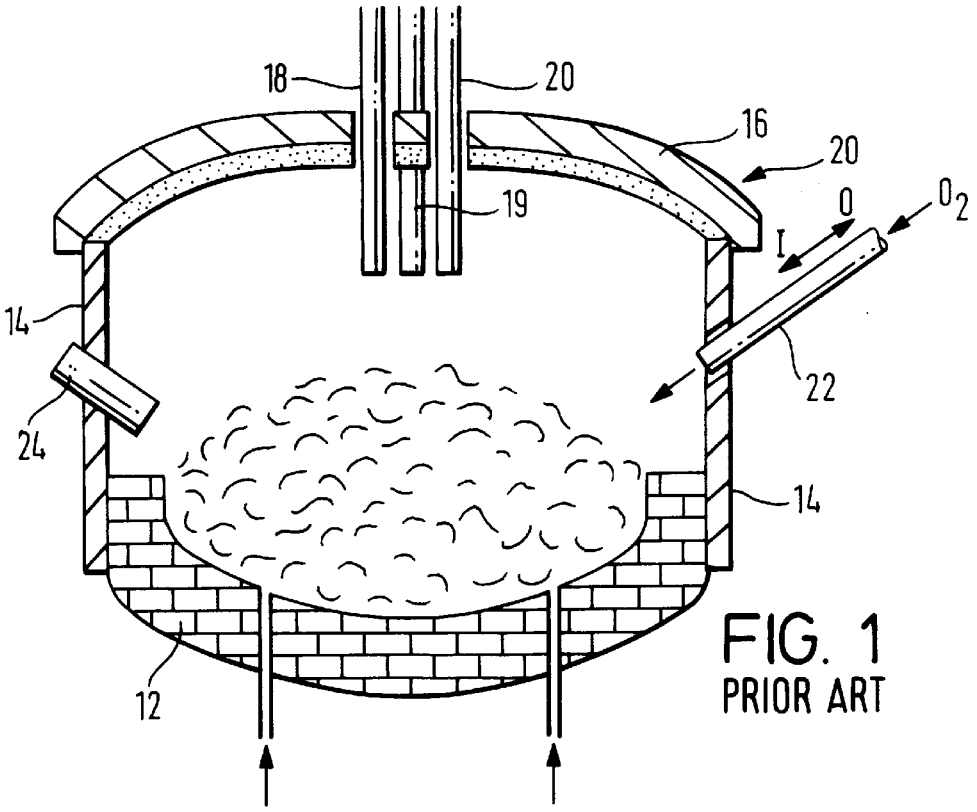
FIG. 1 PRIOR ART
FIGS. 1 and 2 are cross-sectional views of known electric arc furnaces.
Figure 2:
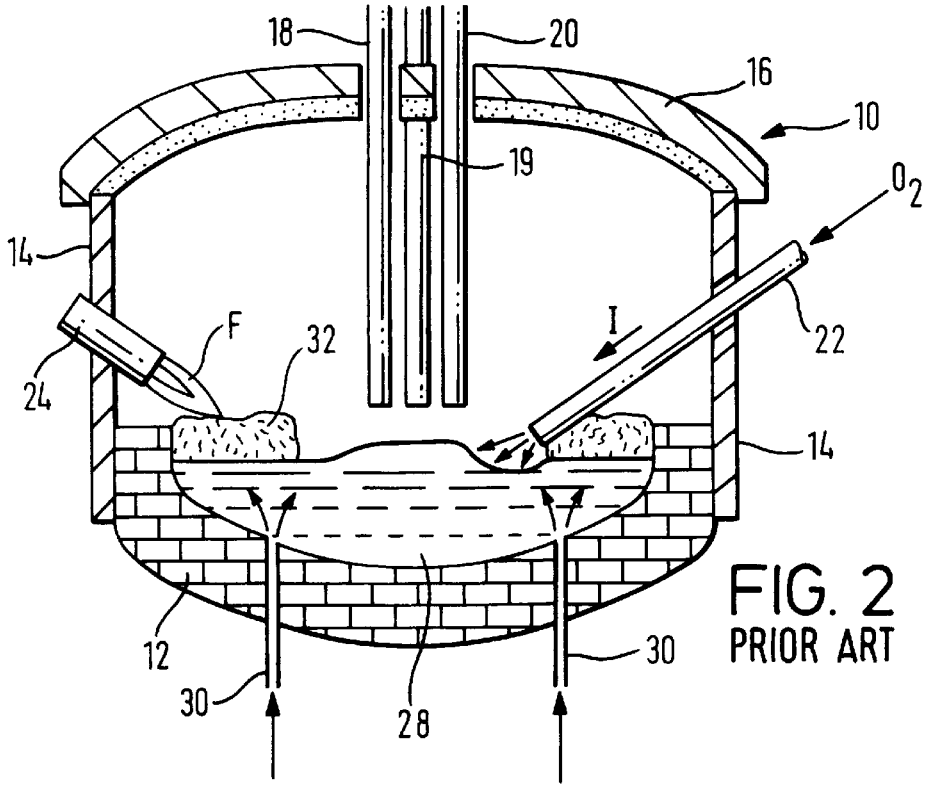
FIG. 2 PRIOR ART

Referring briefly to FIGS. 1 and 2, an electric arc furnace 10 includes a brick lined base 12, furnace walls 14 and a lid portion 16 through which extend electrodes 18, 19, 20. An oxygen lance 22 is positioned for movement in the direction of arrows I, O into and out of the furnace interior in a manner to be described herein below. Supplementary burners, shown at 24 may be provided at various points around the furnace wall and are positioned for directing any heating flame 26 downwardly towards any metal 28 to be melted. Gas tuyeres 30 are positioned for directing gas directly into the main body of any molten metal in a manner also to be described herein below.

In operation, an arc is struck between the electrodes as they are advanced towards the scrap metal 28 such that the electric arc acts to heat and then melt the scrap 28 in a manner well known to those skilled in the art and therefore not described further herein. As the scrap metal begins to melt, the electrodes are advanced further towards the remaining scrap so as to ensure efficient melting and reduce electrode damage. Once the scrap has been fully melted, oxygen lance 22 and, if provided, tuyeres 30 are employed to inject oxygen into the body of the molten metal 28 and oxidise/drive off unwanted impurities which then rise to the surface and form an insulating slag layer shown generally at 32. The slag, whilst providing an important protective layer which prevents the electrodes and furnace walls being damaged by molten metal, acts as an insulating layer which effectively prevents the burners 24 heating the molten metal to its final tap temperature. Gas supplied via tuyeres 30 acts to chill the molten metal, thereby making it even more difficult to reach the final tap temperature.

By stark contrast with the above, the present invention as illustrated in FIGS. 3 to 10 provides an extremely simple and efficient heating/gas injection apparatus which is capable of rapidly melting the scrap metal, efficiently forming the necessary slag layer and easily reaching the final tap temperature. In particular, the present invention provides a combined burner/gas injection apparatus that is able to operate above, in and under the slag layer, thereby eliminating the requirement for electrodes 18, 19 and 20 supplementary burners 24 and tuyeres 30 and being able to impart heat directly to the molten metal as it is raised to the final tap temperature.

Figure 8:
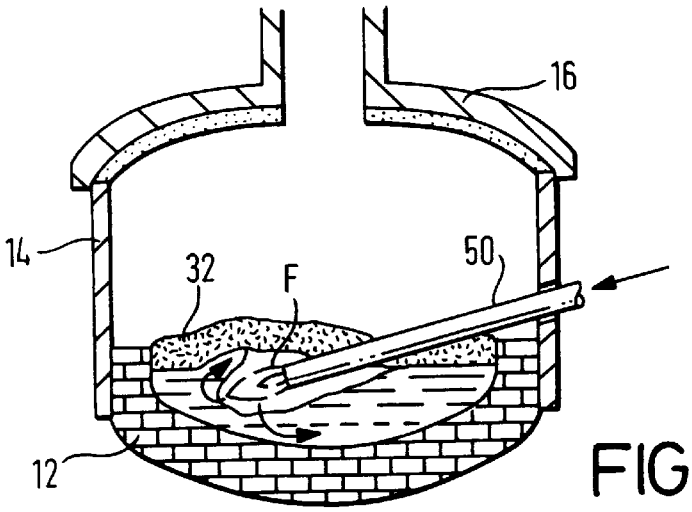
Figure 10:
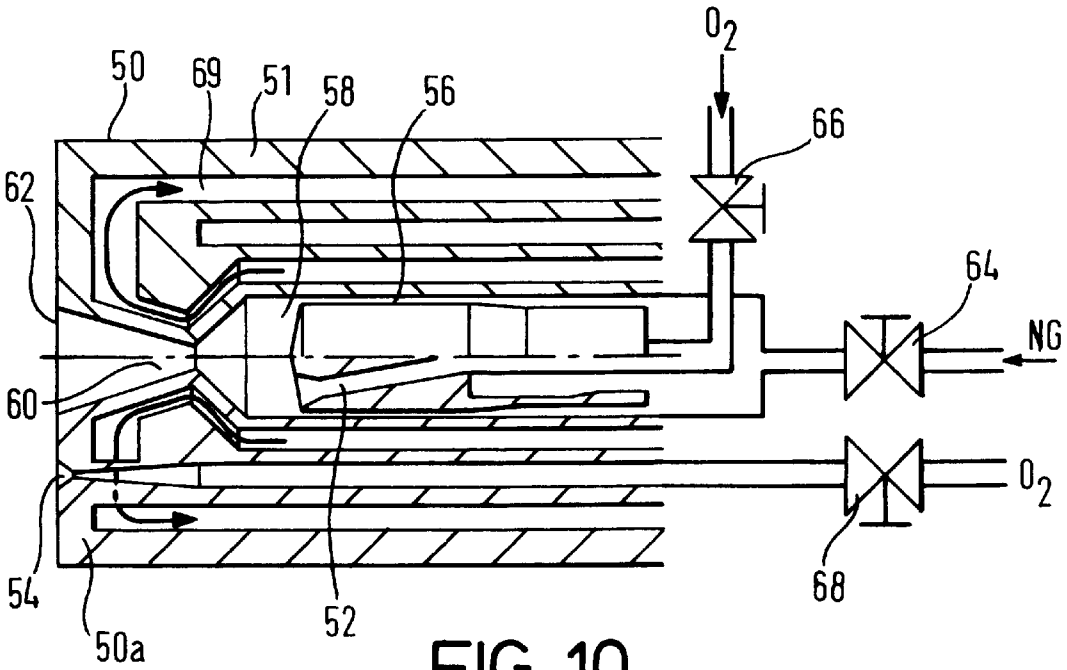
FIG. 10 is a cross-sectional view in the direction of arrows I—I of the burner shown in FIG. 9.
Figure 9:
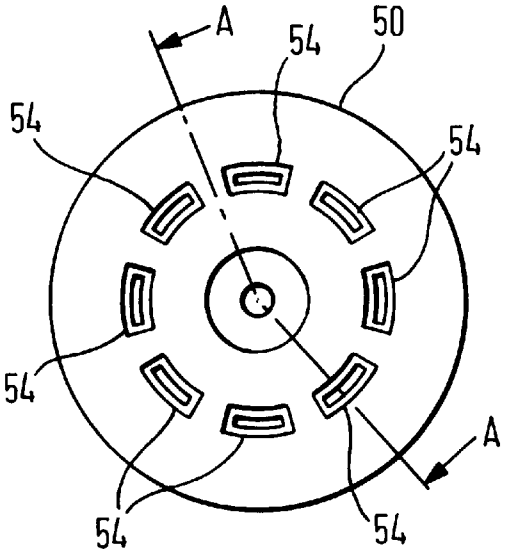
FIG. 9 is an end elevation of a burner according to the present invention.

Referring now to FIGS. 3 to 10 in general but particularly to FIGS. 9 and 10, the present invention provides a burner 50 having a main body portion 51, only the distal end or tip portion 50*a* of which is shown in FIG. 10, primary and secondary oxidant outlets 52, 54 and a fuel outlet 56. Tip portion 50*a* is typically formed of copper or an alloy of copper. The primary oxidant outlet or outlets 52 and the fuel outlet 56 are positioned for discharging fuel/oxidant into a mixing chamber 58 positioned wholly within the body portion 51 and upstream of an acceleration means in the form of convergent-divergent nozzle 60. The outlet end of nozzle 60 acts to define a main outlet 62 of the burner, the function of which will be described herein below. The secondary oxidant outlets 54 are formed by a plurality of slotted outlets circumferentially spaced around the nozzle centre-line and positioned for directing oxidant into a region downstream of outlet 62. Flow control means shown schematically as valves 64, 66 and 68 are provided for controlling the flow of fuel and oxidant to outlets 52 to 56 as and when necessary. A plurality of cooling channels 69 are provided around the tip portion 50*a* of the burner and are linked for the flow of cooling fluid (for example, water) therethrough so as to cool the tip during operation.

The present burner may be operated in a number of different modes. For example, oxygen may be supplied to the primary oxidant passage, and thus fuel is mixed with oxygen either in the mixing chamber 58 inside the burner body 51. Upon ignition, combustion takes place before the convergent-divergent nozzle 60. If combustion takes place before nozzle 60, hot flame gases expand through the nozzle 60 and allow the creation of sonic or supersonic high temperature gas flows capable of penetrating liquid steel. If no oxygen is supplied to the primary oxidant outlet, the burner operates in a tip-mix mode with the root of the flame downstream of the main outlet 62. This mode of operation is sometimes referred to herein as the "tube-in-tube" mode. According to the mode of operation, oxygen may be supplied at high (H), medium (M) or low (L) flowrates from one or other or both oxidant outlets and may be supplied at an oxygen/fuel ratio of greater than, equal to or less than 2:1, thereby providing oxygen rich and oxygen lean combustion.

In contrast with conventional tip-mix burners, where gases mix outside the burner body and oxygen as well as reactive radicals are present over a certain distance outside the burner, the present invention is able to achieve near complete combustion. Consequently, the burner according to present invention is able to avoid the problem of uncertain quantities of reactive species interacting with the metal and producing unwanted changes in yield or product quality. Although, in certain circumstances, it is desirable to use the burner to inject oxidising agents such as $O_2$ in its combustion products, in contrast with conventional burners, where the actual concentration of these species is either unknown or not easily predicted, the burner according to present invention makes possible a controlled method of injection.

Referring to FIGS. 3 to 8 it will be appreciated that the construction of a furnace employing a burner in accordance with the present invention differs from that illustrated in FIGS. 1 and 2. In particular, it will be noted that the electrodes 18, 19, 20, auxiliary burners 24 and tuyeres 30 are not present and that oxygen lance 22 has been replaced by one or more retractable oxy/fuel burners 50 the operation of which is detailed in Table A and illustrated in FIGS. 3 to 7 attached hereto. In order to achieve a good heat transfer and homogeneous melting, it is preferable to provide between three and six burners, depending on furnace size and conditions. It has been found that, optimum performance may be achieved when the burners are operated at a fairly shallow angle θ to the metal surface and, angles (θ) of less than 30° avoid direct impingement on liquid steel.

Figure 3:
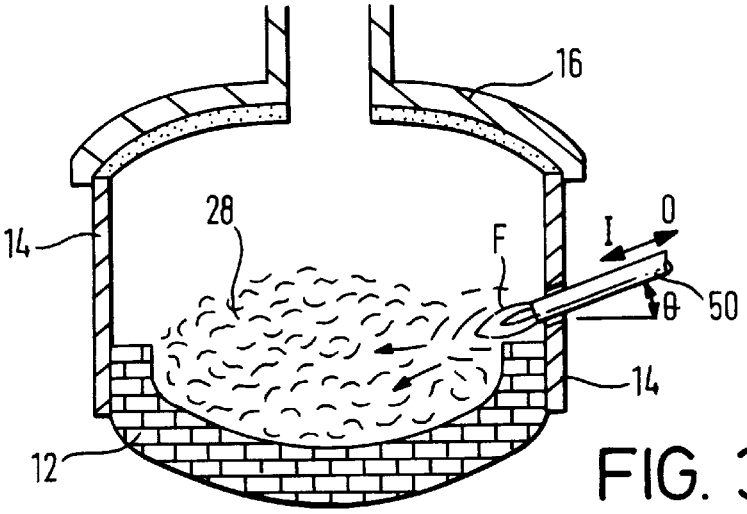
FIGS. 3 to 8 are cross-sectional views of furnaces incorporating a burner in accordance with the present invention.
Figure 4:
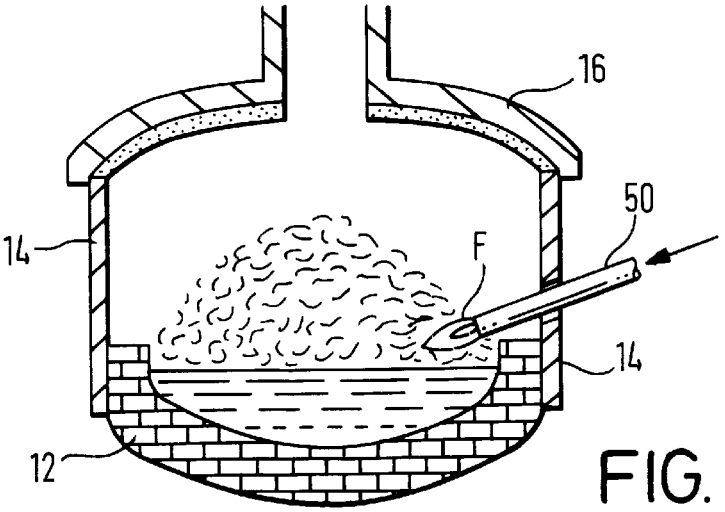
Figure 5:
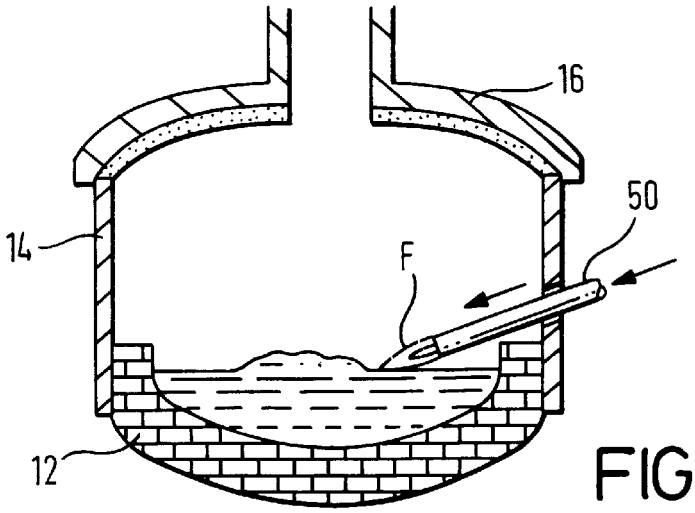

In operation, the furnace 10 is first charged with scrap metal 28 and then burner 50 is fired from a retracted position in which it is protected by the wall 14 of the furnace 10 (FIG. 3). In this mode (mode A) fuel in the form of, for example, natural gas NG is supplied to fuel outlet 56 whilst oxygen is supplied at a first high (H) rate to secondary oxidant outlets 54 only. The burner is effectively operated as a tube-in-tube burner and the flame F is directed generally across the upper surface of any scrap metal and acts to penetrate between lumps thereof, thereby to preheat and melt the scrap 28. The burner 50 is maintained in its retracted position until the height of the scrap has been reduced and it may be advanced closer to the scrap without risk of damage by direct contact with the scrap (mode B).

Figure 6:
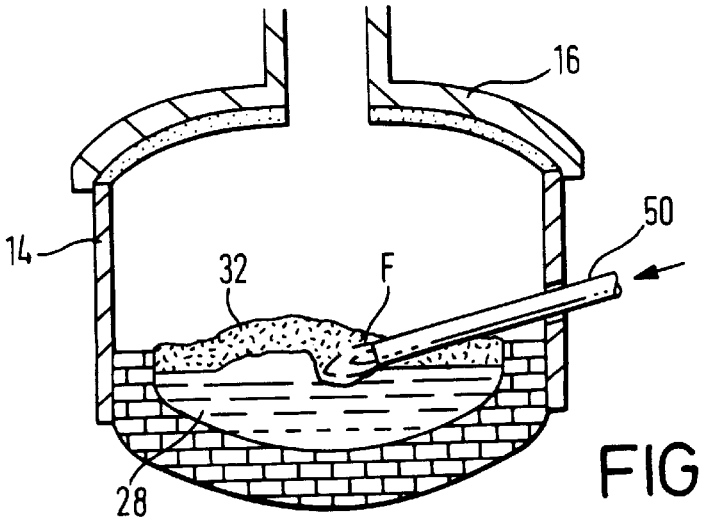
Figure 7:
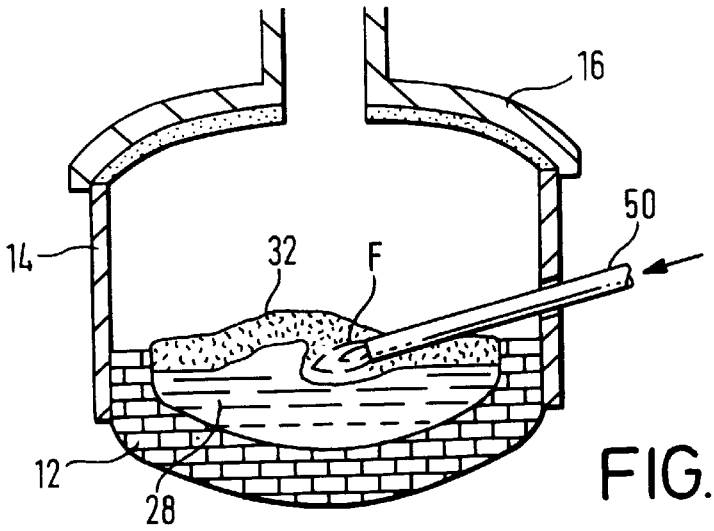

In this second mode, oxygen is supplied at a third low (L) rate and a second medium (M) rate from the primary and secondary oxidant outlets 52, 54 respectively and the burner operates as a "rocket" burner having an oxidant to fuel (mole) ratio of about 2:1 and being non-oxidising. As the scrap is reduced, the burner 50 may be advanced closer to the molten metal 28 and the oxidant/fuel ratio altered to greater than 2:1. In this mode, (mode C and FIG. 4) the rate of oxidant release from secondary oxidant outlets 54 is increased to a high rate (H) and the resulting flame F is such as to be oxidising. Hence, an efficient and intense flame capable of achieving a rapid rate of scrap heating is formed. Since the flame is oxidising the resulting hot oxygen will react with combustible gases such as hydrocarbons, carbon monoxide and hydrogen and secondary (or "post") combustion will therefore take place. The heat released therefrom will contribute towards the raising of the temperature of the scrap. The next step in the process (mode D, FIG. 5) involves moving the burner even closer to the liquid metal and supplying oxidant at high rate (H) from both outlets 52, 54 at superstoichiometric oxidant to fuel ratio such that hot combustion flame gases are accelerated through nozzle 60 and exit outlet 62 at supersonic speed. Secondary oxygen is injected directly into the molten metal and the burner acts in a metal refining and slag forming mode in which undesirable elements within the scrap are oxidised by the excess oxygen and rise to the surface and form the slag layer 32, as illustrated in FIG. 6. The secondary oxygen is heated by the action of flame F, thereby eliminating the cooling effect associated with presently known oxygen injection systems. Once the undesirable elements have been extracted and the slag layer formed, the burner is moved to a position close to the metal/slag interface (mode E, FIG. 6) and continues to be operated in a supersonic mode with high (H) oxidant flowrates from outlets 52, 54 but with an oxidant to fuel mole ratio of less than or equal to 2:1 and slag foaming is achieved.

Combustion gas $CO_2$ acts to foam the slag layer in a manner which avoids the post combustion problems associated with conventional carbon and oxygen injection methods. Once an adequate thickness of slag has been created, the burner is retracted slightly such that it terminates within the slag itself and is then operated in two distinct modes namely sonic and supersonic mode, both of which are identified as step F in Table A and illustrated in FIG. 7. In both the sonic and supersonic modes the gas velocity is substantially in excess of that which obtains when the burner is operated in rocket mode.

Conventionally, slag foaming is achieved by injection of carbon and oxygen simultaneously, or by oxygen injection alone. Any carbon injected into or dissolved in the metal will react with the oxygen to form CO which is the preferred product under the given conditions. The CO emerges into the slag and produces gas bubbles which help generate a foam covering the area around the $O_2$ lance. The operator often attempts to direct the foam in the area of the electrodes as well as close to the furnace walls for the purpose of protection and increase in longevity. This conventional CO forming process suffers from the disadvantages of incomplete combustion and high emission levels together with reduced energy and material efficiencies. These problems may be overcome by the use of a recently developed post combustion system for treating the effluent gas from the furnace, which system completes the combustion reaction by burning the CO to $CO_2$ through additional $O_2$ injection and thus recovering some of the chemical energy and reducing the emission levels. Unfortunately, such separate post combustion systems have proved to be very expensive and complex and hence a better solution has been sought.

The present invention avoids the above-mentioned problems by avoiding the need for such separate post combustion in the gas phase and avoiding the production of large amounts of CO for foamy slag formation. The presently proposed burner 50 injects hot $CO_2$ in mode E and additional $O_2$ in superstoichiometric modes D, F and G (see below) into the slag or metal. The $CO_2$ will be employed to foam the slag directly, any carbon in the metal will be oxidised to CO and subsequently the CO will be burned to $CO_2$ with the available $O_2$ in the slag layer before it can enter the gas phase above the slag layer. Consequently, there is no need for carbon injection and the energy is used more efficiently because the heat released in the reaction from C to $CO_2$ is not obtained by separating the reactions as in the conventional case.

An optional penultimate step of the heating process involves operating the burner as illustrated in FIG. 8 and detailed in mode G of Table A in which the tip of the burner is plunged into the molten metal and relies on the pressure created by the supersonic gas velocity to prevent the burner being extinguished or damaged by the molten metal. In this mode, oxygen is supplied at a high (H) rate to both outlets 52, 54 and the oxygen to fuel ratio is equal to or greater than 2:1. The combustion gases, which include $CO_2$, are capable of providing a stirring action effective to strip some nitrogen from the molten metal as well as inputting heat directly into the molten metal.

The final mode of heating is detailed at H in Table A and involves retraction of the burner 50 to the metal/slag interface and operating it in a sonic or supersonic mode with an oxygen to fuel ratio of less than or equal to 2:1. This direct heating, together with that of mode G acts to elevate the temperature of the molten metal to the final tap temperature and is capable of achieving 2700° C. In mode H, the flame F is non-oxidising and provides a direct heating effect on the upper surface of the metal and is thus not affected by the insulating property of the slag layer 32.

TABLE A

| MODE | NG | $O_2$ (1) | $O_2$ (2) | MODE | $O_2$:FUEL | BURNER POSITION |
|---|---|---|---|---|---|---|
| 1. A | X | — | X H | Tube-in-tube | | Wall, protected |
| B | X | X L | X M | Rocket | 2:1 | Wall, starting protrusion into furnace |
| C | X | X L | X H | Rocket | >2:1 | Wall, protruding |
| 2. D | X | X H | X H | Supersonic | >2:1 | Close to liquid metal |
| E | X | X H | X H | Supersonic | ≦2:1 | Metal/slag interface |
| F | X | X H/M | X H/M | Sonic/Supersonic | >2:1 | Slag |
| G | X | X H | X H | Supersonic | ≧2:1 | Metal |
| 3. H | X | X H/M | X H | Sonic/Supersonic | ≦2:1 | Metal/slag interface |

I claim:

1. A burner comprising:

a body portion, having a main outlet;

at least one primary oxidant supply outlet and at least one secondary oxidant supply outlet, said secondary outlet being positioned for supplying oxidant to a position downstream of said main outlet;

a fuel outlet;

a mixing chamber, within the body portion communicating with said fuel outlet and said primary oxidant supply outlet for mixing fuel and any primary oxidant;

accelerating means, downstream of the mixing chamber, for accelerating gas from the mixing chamber; and oxidant flow control means, for controlling the flow of oxidant from said primary and secondary oxidant supply outlets thereby to cause oxidant to issue at different rates from one or other or both of said oxidant supply outlets during different modes of operation;

whereby upon causing ignition of a mixture of the fuel and one or both of the primary and secondary oxidants, the burner is selectively operable in different modes such that combustion can take place either entirely downstream, or both upstream and downstream of the acceleration means, and such that said burner can produce exhaust gases which exit the burner at subsonic, sonic or supersonic speed.

2. The burner as claimed in claim 1, in which the secondary oxidant supply outlets comprise a plurality of outlets spaced around an end portion of the burner on a circumference radially outward of the main outlet and being positioned for directing secondary oxidant towards gas exiting the main outlet.

3. The burner as claimed in claim 1, in which said acceleration means comprises a convergent-divergent nozzle.

4. The burner as claimed in claim 1, in which said control means is operable selectively to place either the said secondary oxidant supply outlet only or both the primary and said secondary oxidant supply outlets in communication with a source of oxidant.

* * * * *